US009775200B2

(12) United States Patent
Sempel et al.

(10) Patent No.: US 9,775,200 B2
(45) Date of Patent: Sep. 26, 2017

(54) ILLUMINATION SYSTEM COMPRISING AN ARRAY OF LEDS

(71) Applicant: PHILIPS LIGHTING HOLDING B.V., Eindhoven (NL)

(72) Inventors: Adrianus Sempel, Waalre (NL); Theodorus Johannes Petrus Van Den Biggelaar, Veldhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/118,668

(22) PCT Filed: Jan. 27, 2015

(86) PCT No.: PCT/EP2015/051531
§ 371 (c)(1),
(2) Date: Aug. 12, 2016

(87) PCT Pub. No.: WO2015/121054
PCT Pub. Date: Aug. 20, 2015

(65) Prior Publication Data

US 2017/0048934 A1 Feb. 16, 2017

(30) Foreign Application Priority Data

Feb. 12, 2014 (EP) ..... 14154847

(51) Int. Cl.
*H05B 41/16* (2006.01)
*H05B 33/08* (2006.01)
(Continued)

(52) U.S. Cl.
CPC ..... *H05B 33/0809* (2013.01); *F21V 21/14* (2013.01); *H05B 33/08* (2013.01); *H05B 33/0842* (2013.01); *F21Y 2115/10* (2016.08)

(58) Field of Classification Search
CPC ..... H05B 33/0809; H05B 33/0842; H05B 33/0887; H05B 33/0896; H01L 33/52
(Continued)

(56) References Cited

U.S. PATENT DOCUMENTS 5,463,280 A 10/1995 Johnson
6,121,758 A 9/2000 Bellina et al.
(Continued)

FOREIGN PATENT DOCUMENTS

CN 101499808 A 8/2009
JP H0628473 A 10/1994
(Continued)

*Primary Examiner* — Tung X Le
(74) *Attorney, Agent, or Firm* — Meenakshy Chakravorty

(57) ABSTRACT

A capacitive driving system (100) comprises:—a supply device (110) having a set of transmission electrodes (111, 112) located at a top surface (117), and a power generator (13) adapted to generate alternating electrical power;—load devices (200) each having two receiver electrodes (221, 222) at a lower surface (227) and at least one load member (223) coupled to said receiver electrodes. In an energy transfer position, the lower surface of the load device is directed to the top surface of the supply device and at least one of said transmission electrodes together with a corresponding one of said receiver electrodes defines a first transfer capacitor (31). Resonant energy transfer takes place from the supply device to the load member. The load device can be rotated for enabling amendment of the capacitance value of said first transfer capacitor.

15 Claims, 2 Drawing Sheets

(51) Int. Cl.
*F21V 21/14* (2006.01)
*F21Y 115/10* (2016.01)

(58) Field of Classification Search
USPC ..... 315/52, 56, 233, 246
See application file for complete search history.

(56) References Cited

U.S. PATENT DOCUMENTS

| | | | | |
|---|---|---|---|---|
| 7,830,095 | B2 | 11/2010 | Erhardt | |
| 2010/0187913 | A1 | 7/2010 | Smith et al. | |
| 2012/0049640 | A1 | 3/2012 | Ichikawa et al. | |
| 2013/0200717 | A1 | 8/2013 | Bourilkov et al. | |
| 2013/0249306 | A1 | 9/2013 | Kim et al. | |
| 2014/0320043 | A1* | 10/2014 | Radermacher ..... | H05B 33/0845 315/307 |
| 2015/0305103 | A1* | 10/2015 | Shah ..... | H05B 33/0815 315/294 |

FOREIGN PATENT DOCUMENTS

| | | | |
|---|---|---|---|
| KR | 20130041870 | A | 4/2013 |
| WO | 0231406 | A1 | 4/2002 |
| WO | 2009153715 | A2 | 12/2009 |
| WO | 2014060921 | A1 | 4/2014 |

* cited by examiner

ILLUMINATION SYSTEM COMPRISING AN ARRAY OF LEDS

CROSS-REFERENCE TO PRIOR APPLICATIONS

This application is the U.S. National Phase application under 35 U.S.C. §371 of International Application No. PCT/EP2015/051531, filed on Jan. 27, 2015, which claims the benefit of European Patent Application No. 14154847.9, filed on Feb. 12, 2014. These applications are hereby incorporated by reference herein.

FIELD OF THE INVENTION

The present invention relates in general to the field of lighting, and more particularly the present invention relates to a lighting system comprising an array of LEDs, wherein the LEDs are connected to a series capacitor.

BACKGROUND OF THE INVENTION

For powering a LED panel, comprising an array of LEDs, it is traditionally possible to transfer electric power from a source to the LEDs via wires, but this is rather complicated and expensive. Further, for illumination purposes it is typically desirable that all LEDs have mutually the same light output, but it is complicated to achieve this in a wired embodiment. It is to be noted that the individual LED components do not necessarily have mutually identical characteristics: manufacturing tolerances will cause one LED to be brighter than the other, and this difference should be eliminated as much as possible.

In an alternative design, the LEDs are, either individually or as a group, provided with series capacitors for limiting the LED current. Tolerances in these series capacitors will cause variations in the light output between LEDs, and for compensation additional capacitors can be used. U.S. Pat. No. 7,830,095 describes a system where such LEDs are provided with a plurality of mutually parallel capacitors, each capacitor provided with a switch, so that it is possible to adapt the series capacitance value by selectively making or braking one or more of these switches. A problem is, however, that the capacitance variations, and hence the LED current and hence the LED output, can only be varied stepwise. Further, for precise compensation, many trimming capacitors with many corresponding switches are needed, which is expensive, and this problem increases with increasing spread of the LEDs and/or increasing spread of the series capacitors.

In case resonant powering is used, a supply device comprises an AC power generator for generating AC power, and at least one inductor coupled in series with respective series capacitors for the respective LEDs or groups of LEDs. It should be clear to a person skilled in the art that in such case the impedance of the LED array as a whole, and the resonance frequency of the LED array as a whole, will vary with the capacitance variations.

SUMMARY OF THE INVENTION

A general objective of the present invention is to eliminate or at least reduce the above-mentioned problems.

According to an important aspect of the present invention, a lighting system according to the present invention comprises a carrier device with at least one active surface provided with capacitive electrodes. The system further comprises at least one, but typically a plurality, of sub-modules which on the one hand comprise capacitive electrodes for coupling with the carrier device electrodes, and which on the other hand comprise at least one LED. The sub-modules are placed on the carrier. For trimming the light output of the LEDs, the sub-modules are displaced over the carrier surface to vary the capacitive coupling between the sub-modules and the carrier device. The displacement may be a two-dimensional displacement; advantageously, when it is desired that the positions of the sub-modules as a whole remain constant, the sub-modules may be rotated. When the relative positions of the sub-modules are correct, the sub-modules are fixed with respect to the carrier, for instance by gluing or clamping.

To avoid the need to adjust the output frequency of the power source, the frequency of the power source is preferably swept in a frequency range large enough such as to assure that the actual resonance frequency of the array lies within the frequency range. In such way, it is assured that the resonant current is always generated during at least a portion of the frequency sweep period.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
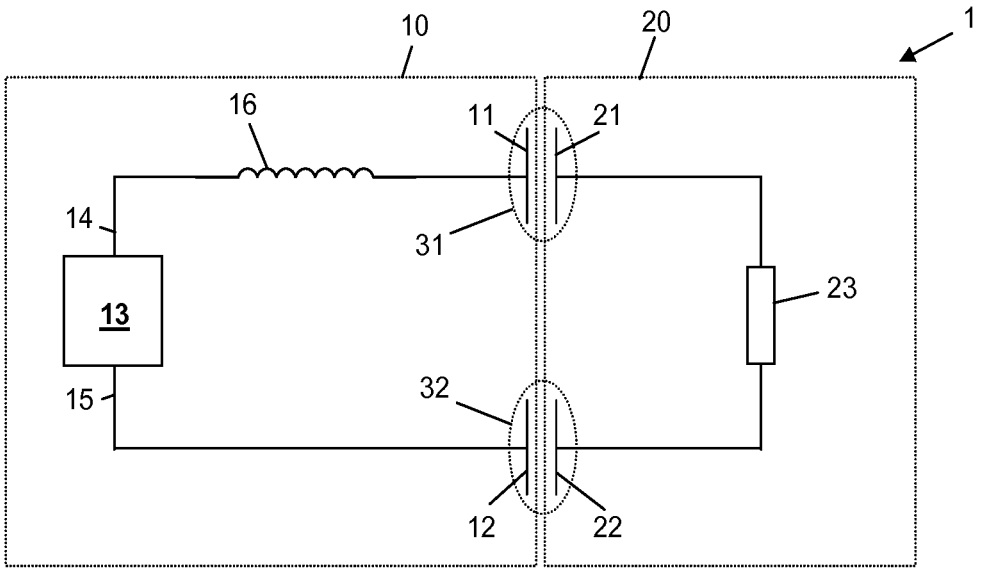
FIG. 1 is a block diagram schematically illustrating a capacitive driving system.

FIG. 1 is a block diagram schematically illustrating a capacitive driving system 1, comprising a supply device 10 and a separate load device 20. In the illustrative example, the supply device 10 comprises two plate-shaped transmission electrodes 11, 12, which can be considered as output terminals. The supply device 10 further comprises a power generator 13 for generating AC power. A first output terminal 14 of the supply device 10 is connected to a first one 11 of the transmission electrodes, while a second output terminal 15 of the supply device 10 is connected to a second one 12 of the transmission electrodes. At least one inductor 16 is connected in series between the supply device 10 and the transmission electrodes 11, 12.

The load device 20 comprises at least one load member 23 connected in series in between a first plate-shaped receiver electrode 21 and a second plate-shaped receiver electrode 22. The load member 23 is depicted as a resistor, and may ideally have ohmic characteristics.

The transmission electrodes 11, 12 are located close to an outer surface 17 of the supply device 10, and the receiver electrodes 21, 22 are located close to an outer surface 27 of the load device 20. The disposition of the receiver electrodes 21, 22 matches the disposition of the transmission electrodes 11, 12, so that the load device 20 and the supply device 10 can be placed in close proximity of each other in an energy transfer position in which the first transmission electrode 11 together with the first receiver electrode 21 defines a first transfer capacitor 31 while simultaneously the second transmission electrode 12 together with the second receiver electrode 22 defines a second transfer capacitor 32.

The inductor 16 together with the capacitors 31 and 32 define a resonance circuit having a resonance frequency, and the power generator 13 is designed to generate an AC output signal at said resonance frequency, so that the circuit operates in resonance and power is efficiently transferred from the power generator 13 to the load member 23.

The precise actual capacitance value of the transfer capacitors 31, 32 depends on the circumstances of the precise actual placement of the load device 20. A displacement of the load device 20 with respect to the supply device 10 will result in variation of the actual capacitance value of the transfer capacitors 31, 32, and thus a variation in the power transferred to the load member 23. The present invention uses this effect to advantage. The present invention already comes into expression with a single load member 23, and the load member 23 may be any type of load. However, in a specifically advantageous embodiment, a capacitive driving system 100 comprises a plurality of load devices 20, and each load device 20 comprises one or more LEDs, and in the following the invention will be explained specifically for this example.

Figure 2A:
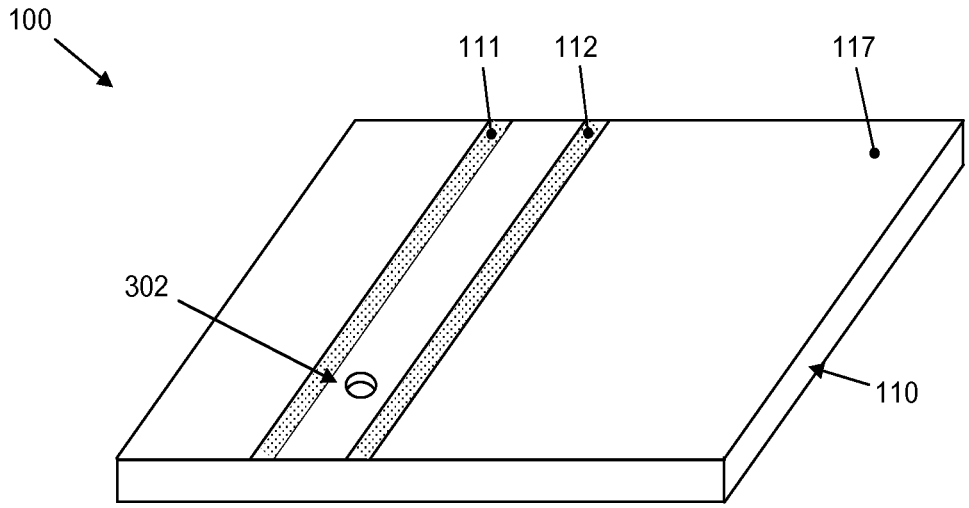
FIG. 2A is a schematic perspective top view of a supply device for a capacitive driving system according to the present invention.

FIG. 2A is a schematic perspective top view of a supply device 110 for the capacitive driving system 100 according to the present invention. The supply device 110 may be identical to the supply device 10 as described above. A top surface is indicated at 117. At the top surface 117, a pattern is arranged of transmission electrodes 111, 112. In the example of FIG. 2A, the transmission electrodes 111, 112 are implemented as elongate strips, mutually parallel, having a certain predetermined width and a certain predetermined mutual distance. Only one pair of electrodes is shown, but the top surface 117 may be provided with multiple such pairs, depending on the size of the top surface 117, as should be clear to a person skilled in the art.

Figure 2B:
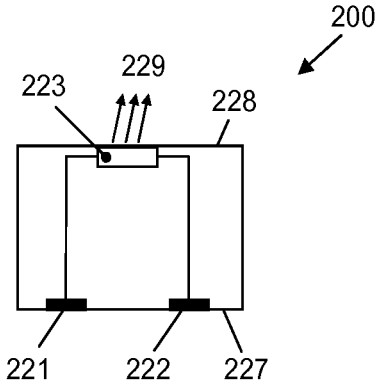
FIG. 2B is a schematic block diagram of a load module for a capacitive driving system according to the present invention.
Figure 2C:
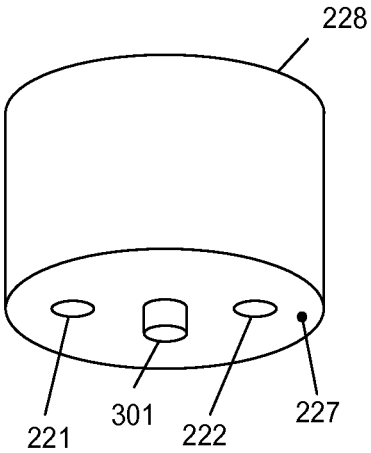
FIG. 2C is a schematic perspective bottom view of the load module.

FIG. 2B is a schematic block diagram of a load module 200, and FIG. 2C is a schematic perspective bottom view of the load module 200. The load module has a lower surface 227 and an opposite top surface 228. At the top surface 228, a LED load 223 is arranged. The LED load 223 may be arranged on the top surface 228, but may also be arranged recessed in the top surface 228. The LED load 223 may contain just one single LED, but the LED load 223 may also comprise an array of two or more LEDs, which LEDs may be electrically connected in series, in parallel, or antiparallel, or a combination thereof, and which LEDs may be arranged distributed over the top surface 228. Similar as in FIG. 1, two receiver electrodes 221, 222 are located close to the lower surface 227. The receiver electrodes 221, 222 may have a circular shape, as shown, with a diameter equal to the width of the transmission electrodes strips 111, 112, but the precise shape and size is not essential. The receiver electrodes 221, 222 may have a mutual distance equal to the mutual distance of the transmission electrodes strips 111, 112, but the precise mutual distance is not essential.

For use, the load module 200 is placed on the top surface 117 of the supply device 110, with its lower surface 227 contacting the top surface 117 of the supply device 110. This contact may be direct, but it may also be that a thin separate dielectric separation layer (not shown) is located between the load module 200 and the supply device 110, in which case the contact is indirect. The contact area does not have to be of the same size as the lower surface 227 of the load module 200: it is for instance possible that a dielectric separation layer has holes so that at that position there is an air gap between the load module 200 and the supply device 110.

In an embodiment, the system 100 comprises just one single load module 200. In another embodiment, the surface area of top surface 117 of the supply device 110 is substantially larger than the footprint of a load module 200, and the system 100 comprises multiple load modules 200 arranged on the top surface 117 of the supply device 110, next to each other. With only one pair of transmission electrodes strips 111, 112 as shown in FIG. 2A, the multiple load modules 200 will substantially be arranged along this pair. To allow having multiple load modules 200 in a direction perpendicular to said one pair of transmission electrodes strips 111, 112, the top surface 117 of the supply device 110 may be provided with multiple pairs of transmission electrodes strips 111, 112, but this is not illustrated for sake of simplicity.

The general light output direction of the system 100 will be substantially perpendicular to the top surface 117 of the supply device 110. The supply device 110 may be used in the orientation shown in the figures, for directing output light upwards. However, the supply device 110 may also be used in an upside-down orientation, for directing output light downwards, or in a vertical direction for directing output light in a horizontal direction. For making the load modules 200 stick to the supply device 110 irrespective of the orientation thereof, the load modules 200 and the supply device 110 may be provided with sticking means. Such sticking means may for instance be electrostatic or electromagnetic, but in a simple embodiment the sticking means may comprise magnets.

In an embodiment, the load modules 200 may have a displacement freedom in two dimensions (X-Y) parallel to the top surface 117 of the supply device 110. When a load module is so displaced, the amount of light output will generally vary with the displacement, unless the displacement is precisely parallel to the pair of transmission electrodes strips 111, 112.

Such displacement freedom, in which the load modules 200 are displaced over the top surface 117 of the supply device 110, results in displacement of the spots where the load modules generate light. This may be a desirable effect, for esthetic purposes. However, it may also be desirable that the light spots are positionally fixed. In a particularly preferred embodiment, the load modules 200 and the supply device 110 are provided with rotary positioning means 300. Such positioning means prevent a displacement along X- and Y-directions, but allow a rotary movement around a rotary axis perpendicular to the top surface 117 of the supply device 110. As an example, in FIG. 2C the load module 200 has a positioning pin 301 projecting from its lower surface 227 while the top surface 117 of the supply device 110 is provided with positioning recesses 302 (only one being shown for sake of simplicity) into which such positioning pin 301 fits. Obviously, pins and recesses may be interchanged, but this is not illustrated for sake of simplicity.

Again, it may be intended that the user varies the light output per light spot to obtain a desired light spot pattern, and to change that pattern at will. For such embodiment, the system may again have sticking means as described above. It is also possible that it is intended to provide a light panel with fixed properties, where the displacement of the load modules 200 is only needed once on manufacturing or on installing the system, for instance for trimming the load modules 200 such that their light outputs are mutually identical. In such case, after setting the load modules 200 in their final positions, these positions may be fixated, for instance by a drop of glue, or by a mechanical clamp, or by a screw.

In the example of FIGS. 2A-C, the positioning pin 301 is shown symmetrically between the two receiver electrodes 221, 222 while the positioning recesses 302 is shown symmetrically between the two transmission electrodes 111, 112. In such condition, rotation of the load module 200 will cause simultaneous variation of the capacitance values of both of said first and second transfer capacitors 31, 32. However, the positioning of the load modules 200 does not have to be symmetrical with respect to the transmission electrodes 111, 112, and the variation of the capacitance values of the first and second transfer capacitors 31, 32 does not have to be symmetrical. It is therefore even possible that the rotary axis coincides with one of the receiver electrodes 221, 222 such that the corresponding transfer capacitors keeps a constant capacity. It is further noted that, for capacitive energy transfer, it suffices if one of the two receiver electrodes 221, 222 defines a transfer capacitor with the corresponding transmission electrode: the other electrode may have a galvanic contact with the corresponding transmission electrode. Also, for instance, in FIG. 2C pin 301 may be a galvanic contact electrode, and electrode 222 may be omitted or connected in parallel to electrode 221.

In embodiments having one galvanic contact and one capacitive contact, it will be advantageous if the power generator 13 has one output terminal (for instance 15) connected to ground, while that grounded terminal would be connected to the capacitive output contact and the non-grounded output terminal would be connected to the galvanic contact.

In the above, varying the capacitance of a capacitive coupling is explained in the context of a varying electrode overlap when a load module is displaced. However, as an alternative or as an addition, it is also possible to vary capacitance by varying the electrode distance. In embodiments like the one illustrated in FIG. 2C, where the load module is rotated, it is possible that the pin 301 is threaded and that the corresponding recess 302 has a matching thread. In such case, screwing the load module clockwise or counter-clockwise will increase or decrease the electrode distance. Advantageously, the pin 301 would be a galvanic contact.

Figure 3:
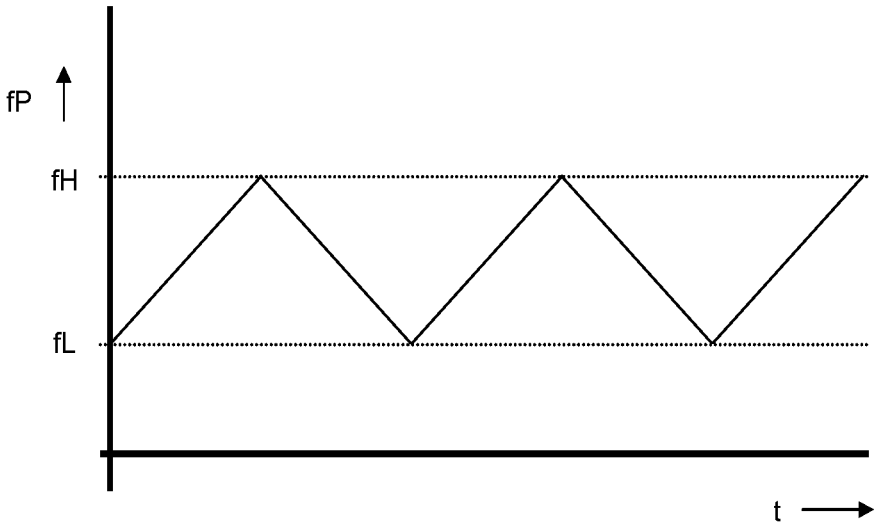
FIG. 3 is a graph illustrating frequency sweeping.

When varying the positions of the load modules 200 to vary the light output of such modules, the operational capacitance of the entire load system changes, and consequently, when the power source of the supply device 110 operates at a constant frequency, the power transfer to the entire load system changes, which would not only affect the light output of the load modules 200 whose positions are being changed but also the light output of the load modules 200 which remain stationary. To counteract this, it would be possible to (manually) vary to frequency of the power source to find the new optimum frequency belonging to the new positional setting of the load modules 200. In a preferred embodiment, however, the power source is adapted to sweep its frequency within a frequency range between a predefined lower border frequency fL and a predefined upper border frequency fH. FIG. 3 is a graph showing output frequency (vertical axis) as a function of time (horizontal axis) in an example of a possible frequency sweep pattern. The exemplary pattern is a triangular pattern; alternative examples are a sawtooth pattern, a sine pattern, etc. Such patterns are known per se and need no further explanation. It should be clear that, within the repetition time period of the sweep pattern, and assuming that the optimum frequency is located between said two border frequencies, the output frequency becomes equal to the optimum frequency at least once. The repetition frequency is preferably higher than 100 Hz such that the sweeping is not perceived by a human observer.

Summarizing, the present invention provides a capacitive driving system that comprises:

- a supply device 110 having a set of transmission electrodes 111, 112 located at a top surface 117, and a power generator 13 adapted to generate alternating electrical power;
- load devices 200 each having two receiver electrodes 221, 222 at a lower surface 227 and at least one load member 223 coupled to said receiver electrodes.

In an energy transfer position, the lower surface of the load device is directed to the top surface of the supply device and at least one of said transmission electrodes together with a corresponding one of said receiver electrodes defines a first transfer capacitor 31. Resonant energy transfer takes place from the supply device to the load member. The load device can be rotated for enabling amendment of the capacitance value of said first transfer capacitor.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, while the design of the transmission electrodes 111, 112 is exemplary shown as elongate strips, the electrodes may also have a different design. For instance, the transmission electrodes may be designed as radial electrodes with respect to a positioning pen or recess 302, or as spiral-shaped electrodes spiraling around a positioning pen or recess 302. Furthermore, while the top surface 117 of the supply device 110 is discussed as being a flat surface, it may alternatively be a curved surface.

In the above, the two receiver electrodes 221, 222 of the load module 200 are described as being fixed with respect to the lower surface 227 of the load module 200. In such case, variation of the coupling capacitance is obtained by displacing the load module as a whole with respect to the top surface 117 of the supply device 110. It is however also possible that at least one of said two receiver electrodes 221, 222 of the load module 200 is displaceable with respect to the lower surface 227 of the load module 200. In such case, variation of the coupling capacitance can be obtained even if the load module 200 is kept fully stationary with respect to the supply device 110, namely by displacing the displaceable electrode(s) with respect to the lower surface 227 of the load module 200 and hence with respect to the transmission electrode(s) 111, 112.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Even if certain features are recited in different dependent claims, the present invention also relates to an embodiment comprising these features in common. Any reference signs in the claims should not be construed as limiting the scope.

The invention claimed is:

1. A capacitive driving system, comprising:

a supply device having a top surface, the supply device comprising at least one set of transmission electrodes located at said top surface, and a power generator having two output terminals coupled to respective ones of the transmission electrodes, wherein the power generator is adapted to generate electrical power having at said output terminals alternating voltage at a certain power frequency;

at least one load device having a lower surface, the load device comprising two receiver electrodes at said lower surface and at least one load member coupled to said receiver electrodes;

wherein the supply device and the load device have an energy transfer position in which the lower surface of the load device is directed to the top surface of the supply device and in which at least one of said transmission electrodes together with a corresponding one of said receiver electrodes defines a first transfer capacitor;

wherein, in the energy transfer position, resonant energy transfer takes place from the supply device to the load member;

and wherein, in the energy transfer position, at least said corresponding one receiver electrode has a displacement freedom with respect to the corresponding transmission electrode for enabling amendment of the capacitance value of said first transfer capacitor.

2. The capacitive driving system according to claim 1, comprising a plurality of load devices arranged next to each other on the top surface of the supply device.

3. The capacitive driving system according to claim 1, wherein the load device is an illumination load device and said load member comprises at least one LED.

4. The capacitive driving system according to claim 3, wherein the load member comprises an array of LEDs arranged in parallel to each other and/or in series to each other and/or anti-parallel to each other.

5. The capacitive driving system according to claim 1, wherein the load device as a whole has a displacement freedom in at least one direction parallel to the top surface of the supply device for enabling amendment of the capacitance value of said first transfer capacitor.

6. The capacitive driving system according to claim 5, provided with rotary positioning means that are adapted to prevent shifting the respective load devices along the top surface of the supply device but to allow a rotary movement of the respective load devices around a rotary axis perpendicular to the top surface of the supply device.

7. The capacitive driving system according to claim 6, wherein each load device has a positioning pin projecting from its lower surface while the top surface of the supply device is provided with positioning recesses for receiving the respective positioning pins of the respective load devices, or wherein each load device has a positioning recess in its lower surface while the top surface of the supply device is provided with projecting positioning pins for receiving the respective positioning recesses of the respective load devices.

8. The capacitive driving system according to claim 1, wherein displacement of said corresponding one receiver electrode effects a variation in overlap with the corresponding transmission electrode thus amending the capacitance value of said first transfer capacitor, and/or wherein displacement of said corresponding one receiver electrode effects a variation in distance between said corresponding one receiver electrode and the corresponding transmission electrode thus amending the capacitance value of said first transfer capacitor.

9. The capacitive driving system according to claim 1, wherein at least one of said two receiver electrodes of the load module is displaceable with respect to the lower surface of the load module.

10. The capacitive driving system according to claim 1, wherein the other receiver electrode is capacitively coupled to its corresponding transmission electrode or is galvanically coupled to its corresponding transmission electrode.

11. The capacitive driving system according to claim 1, wherein the supply device is adapted to sweep the power frequency of the power generator within a frequency range between a predefined lower border frequency and a predefined upper border frequency.

12. A method for adapting the light output of an illumination load device in a capacitive driving system, the capactive driving system comprising a supply device having a top surface, the supply device comprising at least one set of transmission electrodes located at said top surface, and a power generator having two output terminals coupled to respective ones of the transmission electrodes, wherein the power generator is adapted to generate electrical power having at said output terminals alternating voltage at a certain power frequency, the method comprising the step of displacing, with respect to the supply device, the illumination load device, the illumination load device having a lower surface comprising two receiver electrodes and further comprising at least one load member, coupled to said receiver electrodes, the at least one load member comprising an array of LEDs arranged in parallel to each other and/or in series to each other and/or anti-parallel to each other, wherein the illumination load device is displaced with respect to the supply device while in an energy transfer position in which the lower surface of the illumination load device is directed to the top surface of the supply device and in which at least one of said transmission electrodes together with a corresponding one of said receiver electrodes defines a first transfer capacitor, wherein, in the energy transfer position, resonant energy transfer takes place from the supply device to the load member;

and wherein the displacement of at least said corresponding one receiver electrode with respect to the corresponding transmission electrode enables amendment of the capacitance value of said first transfer capacitor.

13. The method according to claim 12, wherein the step of displacing the illumination load device with respect to the supply device, comprises rotating the illumination load device with respect to the supply device.

14. A method for manufacturing a capacitive illumination system, the method comprising the steps of:

providing a supply device having a top surface, the supply device comprising at least one set of transmission electrodes located at said top surface, and a power generator having two output terminals coupled to respective ones of the transmission electrodes, wherein the power generator is adapted to generate electrical power having at said output terminals alternating voltage at a certain power frequency;

providing a plurality of illumination load devices each having a lower surface, each load device comprising two receiver electrodes at said lower surface and at least one illumination load member coupled to said receiver electrodes, wherein said load member comprises at least one LED;

placing the load devices in energy transfer positions on the supply device, wherein the lower surface of each load device is directed to the top surface of the supply device and in which at least one of said transmission electrodes together with a corresponding one of said receiver electrodes defines a first transfer capacitor;

effecting resonant energy transfer from the supply device to the load member;

displacing at least one of the illumination load devices, in the energy transfer positions, with respect to the supply device for adapting the light output of the illumination load devices; and fixating the illumination load devices with respect to the supply device.

15. The method for manufacturing according to claim 14, wherein the supply device and the respective load devices are provided with rotary positioning means that are adapted to prevent shifting the respective load devices along the top surface of the supply device but to allow a rotary movement of the respective load devices around a rotary axis perpendicular to the top surface of the supply device; wherein the step of displacing at least one of the illumination load devices with respect to the supply device for adapting the light output of the illumination load devices comprises the steps of rotating the illumination load devices with respect to the supply device.

* * * * *